US005083813A

United States Patent [19]

Adkins

[11] Patent Number: 5,083,813

[45] Date of Patent: Jan. 28, 1992

[54] CLIP FOR SKI POLE

[76] Inventor: Keith W. Adkins, S. 11 Barker Rd., Green Acre, Wash. 99016-9704

[21] Appl. No.: 574,670

[22] Filed: Aug. 29, 1990

Related U.S. Application Data

[63] Continuation-in-part of Ser. No. 341,542, Apr. 21, 1989, Pat. No. 4,953,892.

[51] Int. Cl.[5] ..... A63C 11/22

[52] U.S. Cl. ..... 280/821; 248/340

[58] Field of Search ..... 280/814, 819, 821, 822, 280/809; 248/322, 340; 16/10 R

[56] References Cited

U.S. PATENT DOCUMENTS

| | | | |
|---|---|---|---|
| 2,340,868 | 2/1944 | Dye | 280/814 X |
| 4,002,349 | 1/1977 | Dopp | 280/814 |
| 4,059,208 | 11/1977 | Koepcke | 280/814 |
| 4,269,435 | 5/1981 | Jarvenkyla | 280/814 |
| 4,341,400 | 7/1982 | Morgan | 280/819 |
| 4,582,341 | 4/1986 | Erickson | 280/819 X |

*Primary Examiner*—Robert P. Olszewski
*Assistant Examiner*—Michael Mar
*Attorney, Agent, or Firm*—Keith A. Cushing

[57] ABSTRACT

A ski pole clip securely attaches a ski pole to a ski lift relieving a skier of the burden of holding the ski pole during a ski lift ride. The clip includes a first portion adapted for attachment to a ski pole and a second portion adapted for attachment to a portion of the ski lift. The clip is light-weight and remains attached to the ski pole during use of the ski pole, but does not interfere with use of the ski pole.

6 Claims, 3 Drawing Sheets

CLIP FOR SKI POLERELATED APPLICATIONS

This application is a continuation-in-part of application No. 07/341,542, filed Apr. 21, 1989, entitled "Ski Pole Clip," U.S. Pat. No. 4,953,892.

BACKGROUND OF THE INVENTION

The present invention relates to ski equipment and particularly to an apparatus for attaching a ski pole to a ski lift.

Skiers reach the top of a ski run by boarding a ski lift at the bottom of the ski run and riding the ski lift to the top of the ski run. During the ski lift ride the skier is usually at least twenty feet off the ground and cannot get off the ski lift until the ski lift reaches the top of the ski run. While riding the ski lift, skiers must keep a firm grip on their ski poles or sit upon their poles. If a ski pole falls to the ground below the ski lift, the skier has no immediate recourse for retrieving the pole. The skier must ride to the top of the ski run and ski down to the site of the dropped pole.

The ski lift ride presents an opportunity to relax, adjust ski clothing, apply lip ointment, or clean foggy goggles. These activities are hampered, however, by the need to keep a firm hold on the ski poles. Sitting on ski poles is uncomfortable so most skiers attempt to hold their poles while riding the ski lift. Despite best efforts, many skiers drop their ski poles during the ski lift ride. The dropped poles are often lost or stolen. In any case, ski poles lying on the ski run are a hazard to other skiers. It is therefore desirable that skiers have some way to secure their ski poles to the ski lift during the ski lift ride.

Ski poles incorporating a large flexible hooklike structure into the ski pole handle are available. The flexible structure wraps around the back of the skier's hand as the skier grips the ski pole handle. During the ski lift ride, the skier hangs the flexible structure of the handle upon a portion of the ski lift. Because the flexible structure is designed to wrap around the back if the skier's hand, the structure is not well adapted to attach securely to the ski lift. The flexible structure does not closely receive the ski lift structure or exert a gripping force on the ski lift. The skier can accidentally bump the ski pole and dislodge it from the ski lift. Also, many skiers prefer a ski pole without the flexible structure on the handle because the flexible structure interferes with us of the pole.

SUMMARY OF THE INVENTION

In accordance with a preferred embodiment of the present invention, a ski pole clip includes a first portion that is shaped for releasable attachment to a ski pole and a second portion that is shaped for releasable attachment to a ski lift. The clip remains attached to the ski pole while the ski pole is used and conveniently attaches to the ski lift after the skier boards the ski lift.

In a second embodiment of the present invention the ski pole clip is either permanently attached to the ski pole or formed as part of the ski pole handle.

It is an object of the present invention to provide an inexpensive ski pole clip adapted for attachment of ski poles to a majority of ski lifts presently in use.

The subject matter of the present invention is particularly pointed out and distinctly claimed in the concluding portion of this specification. Both the organization and method of operation of the invention, together with further advantages and objects thereof, however, may best be understood by reference to the following description and accompanying drawings wherein like reference characters refer to like elements.

DETAILED DESCRIPTION OF THE INVENTION

The present invention is a ski pole clip for attaching a ski pole to a ski lift. The ski pole clip is light-weight and attaches to the ski pole shaft just below the ski pole handle. The clip remains attached to the ski pole while the skier skies and does not interfere with use of the pole. The clip also attaches to a portion of the ski lift such that the ski pole may be attached to the ski lift during the ski lift ride. The skier is then free to relax, adjust clothing, apply lip ointment or clean foggy goggles without risk of losing his or her ski pole. Just before disembarking from the ski lift, the skier easily detaches the clip from the ski lift.

Figure 1:
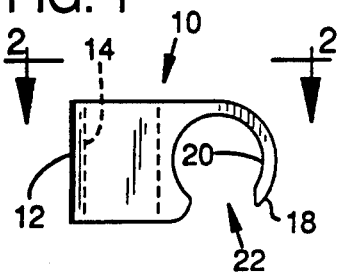
FIG. 1 is a side view of a ski pole clip according to preferred embodiment of the present invention.
Figure 2:
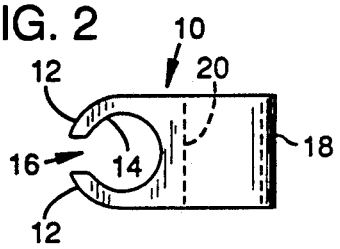
FIG. 2 is a top view of the ski pole clip of FIG. 1 taken along lines 2—2 of FIG. 1.

FIGS. 1 and 2 illustrate a ski pole clip 10 according to a preferred embodiment of the present invention. FIG. 1 is a side view of clip 10, and FIG. 2 is a top view of clip 10 taken along lines 2—2 of FIG. 1. Clip 10 is a cast body formed by injection molding with a first wall formation 12 defining a substantially cylindric aperture 14 for receiving a ski pole shaft. Wall formation 12 includes passage 16 for admitting the ski pole shaft into aperture 14. A second wall formation 18 defines a substantially cylindric aperture 20 for receiving a cylindric portion of a ski lift armrest. Wall formation 18 includes passage 22 for inserting the ski lift armrest into aperture 20.

Figure 3:
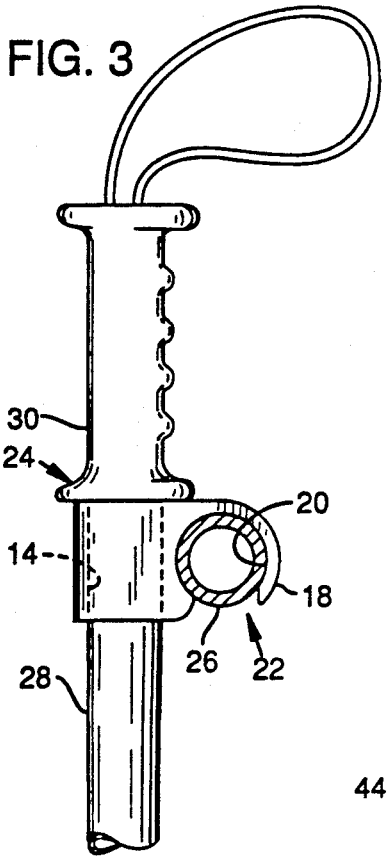
FIG. 3 shows the ski pole clip if FIG. 1 attached to a ski pole and a ski lift.

FIG. 3 shows clip 10 attached to a ski pole 24 and cylindric armrest 26, shown in cross section, such that ski pole 24 may depend from armrest 26 as a skier rides the ski lift. Clip 10 attaches to pole 24 by inserting shaft 28 of pole 24 within aperture 14. During use of ski pole 24, clip 10 remains attached to shaft 28 just below handle 30. With pole 24 vertically oriented and clip 10 attached to shaft 28 as shown in FIG. 3, it is seen that passage 22 is downward facing. Wall formation 18 serves as a hook for closely receiving armrest 26. Clip 10 securely attaches ski pole 24 to armrest 26 as the armrest 26 is inserted within aperture 20 by way of passage 22.

Figure 5:
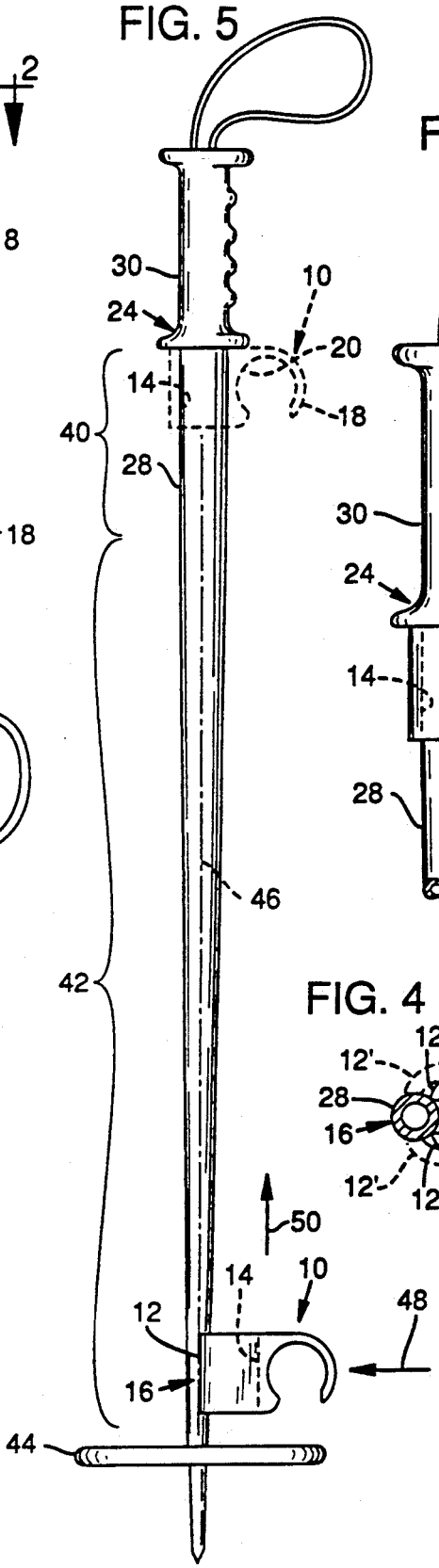
FIGS. 4 and 5 illustrate attachment of the ski pole clip to the ski pole.
Figure 4:
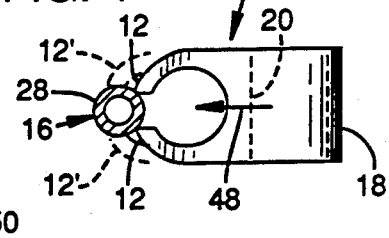

FIGS. 4 and 5 illustrate attachment of clip 10 to ski pole 24. In accordance with the preferred embodiment of the present invention, clip 10 attaches to conventional ski poles having standard shaft diameters. In FIG. 5, shaft 28 has two contiguous length portions, upper length portion 40 having a constant 1.9 cm diameter and lower length portion 42 having a 1.9 cm diameter adjacent to length portion 40 but tapering down to a 0.6 cm diameter near basket 44. Length portions 40 and 42 are each concentric with respect to a central shaft axis 46. Passage 16 permits entry of the 0.6 cm diameter region of length portion 42 within aperture 14 by lateral movement of clip 10 with respect to shaft axis 46, as indicated by arrow 48. Longitudinal movement of clip 10 with respect to shaft axis 46, as indicated by arrow 50, brings length portion 40 within aperture 14 and positions clip 10 in its mounting position just below handle 30.

Wall formation 12 is resilient and exerts a gripping force on shaft 28. In FIG. 4, the width of passage 16 is slightly less than 0.6 cm. Inserting the 0.6 cm diameter region of length portion 42 in passage 16, as described above, deforms wall formation 12 as shown at 12'. Once shaft 28 enters aperture 14, clip 10 will not fall from shaft 28 if it happens to slip from its mounting position just below handle 30.

The resiliency of wall formation 12 also secures clip 10 in its mounting position just below handle 30. The diameter of aperture 14 is less than 1.9 cm. When length portion 42 enters aperture 14, as described above, length portion 42 exerts a deforming force on wall formation 12 expanding wall formation 12 to a position similar to that shown at 12' in FIG. 4. Wall formation 12 thereby exerts a gripping force on shaft 28 and clip 10 remains in its mounting position.

Figure 6:
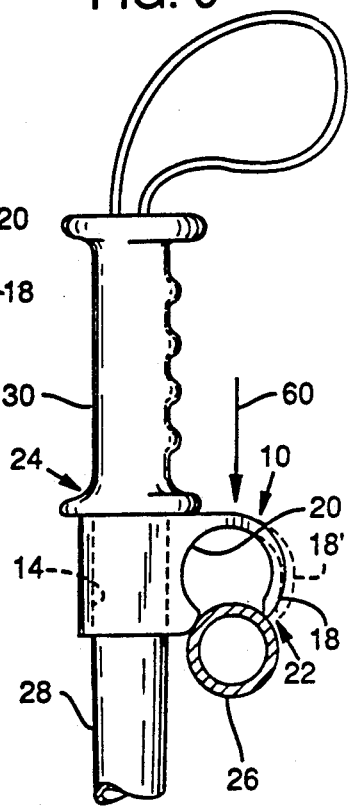
FIG. 6 illustrates attachment of the ski pole clip to the ski lift.

FIG. 6 illustrates attachment of clip 10 to armrest 26. It has been found that a majority of ski lifts have a cylindric horizontally disposed armrest with a 2.2 cm diameter. The diameter of aperture 20 is less than 2.2 cm. Clip 10 mounts to armrest 26 by first positioning passage 22 over armrest 26, as shown in FIG. 6. Moving clip 10 laterally with respect to armrest 26, or downward as shown by arrow 60, forces armrest 26 into aperture 20 by way of passage 22. Wall formation 18 is resilient and as armrest 26 enters passage 22, armrest 26 exerts a deforming force on wall formation 18. Wall formation 18 is deformed as shown at 18'. Because the diameter of aperture 20 is less than the diameter of armrest 26, wall formation 18 cannot rebound to its original position upon full insertion of armrest 26 in aperture 20. Clip 10 thereby maintains a gripping force on armrest 26 and remains secured to armrest 26.

Figure 7:
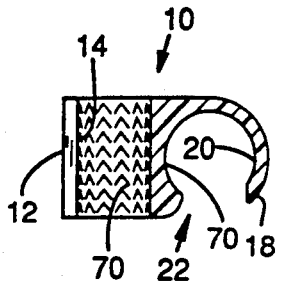
FIGS. 7 and 8 are cross sectional views of the ski pole clip showing surface texture for greater gripping action.
Figure 8:
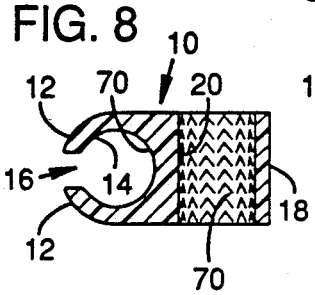

FIGS. 7 and 8 show clip 10 in cross section and illustrate surface texturing within apertures 14 and 20. Surface texturing may be used to enhance the ability of clip 10 to secure ski pole 24 to armrest 26. Score marks 70 on the interior surfaces of wall formations 12 and 18 increase the frictional characteristics of wall formations 12 and 18 per a given amount of gripping force. Score marks 70 may be formed as part of the injection molding process creating clip 10, or may be applied to clip 10 after the molding process.

Figure 9:
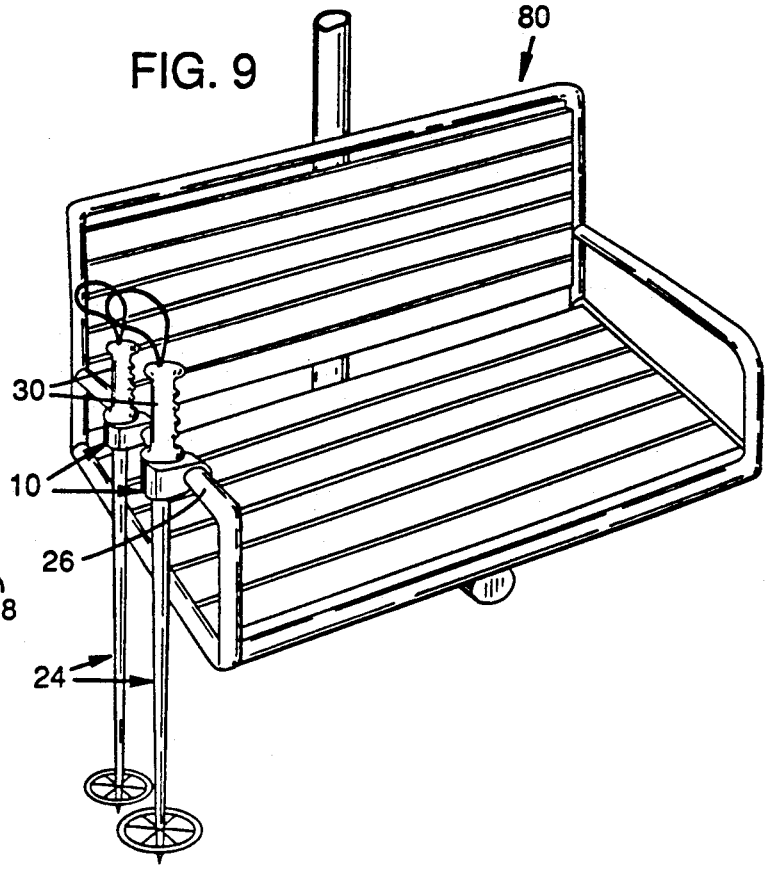
FIG. 9 is a perspective view of a pair of ski poles secured to the ski lift by ski pole clips.

FIG. 9 shows a pair of ski poles 24 each attached to armrest 26 of ski lift 80 by separate ski pole clips 10. After the skier boards lift 80 and begins the ride to the top of the ski run, poles 24 are easily attached to armrest 26. Clips 10 are positioned over armrest 26 and pushed downward to insert armrest 26 in apertures 20 (not shown in FIG. 9). Because clips 10 closely receive armrest 26 and exert a gripping force on armrest 26, poles 24 remain secured to lift 80 even if the skier happens to bump the ski poles during the ski lift ride. Just before getting off ski lift 80, the skier easily removes poles 24 from lift 80 by lifting upward on clips 10 to remove armrest 26 from apertures 20. Thus, ski pole clips 10 offer convenient and secure attachment of ski poles 24 to ski lift 80. Furthermore, clips 10 can remain attached to ski poles 24 without interfering with use of poles 24.

In the preferred embodiment, clip 10 attaches to a conventional ski pole, i.e., to a 1.9 cm diameter portion of the ski pole shaft, and to a common structure found on ski lifts, i.e., a cylindric armrest having a 2.2 cm diameter. It should be understood, however, that the scope of the present invention includes ski pole clips adapted for attachment to other structures. For example, aperture 20 could be modified in shape or dimension to accommodate other ski lift structures. Because clip 10 is inexpensive and light-weight, a skier can afford to own and carry several ski pole clips adapted for use with different ski lift structures. Because the ski pole clip is releasably attachable to both the ski pole and the ski lift structure, the skier can easily switch clips when necessary.

Figure 10:
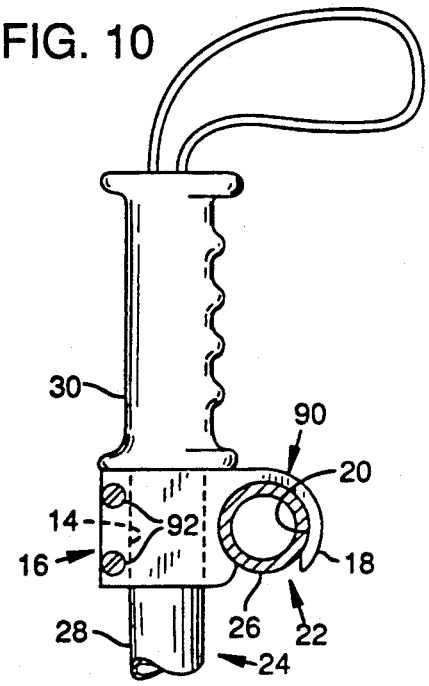
FIGS. 10, 11, and 12 show alternative embodiments of the present invention.

While the preferred embodiment of the present invention contemplates a clip releasably attachable to the ski pole, the scope of the present invention includes a ski pole clip more permanently mounted to the ski pole. In FIG. 10, ski pole clip 90 is similar to ski pole clip 10 in that it includes a resilient wall formation 18 defining aperture 20 and passage 22 for securing clip 90 to armrest 26. Clip 90 also includes a wall formation 12 defining aperture 14 and passage 16 for receiving shaft 28 of pole 24. However, clip 90 additionally includes mounting screws 92 spanning passage 16 and serving to tighten wall formation 12 against shaft 28. In this embodiment clip 90 is more securely attached to pole 24 as compared to clip 10, but is not as easily removable from shaft 28.

Figure 11:
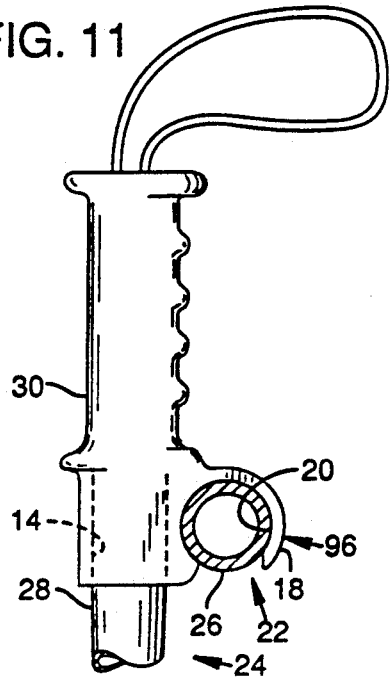
Figure 12:
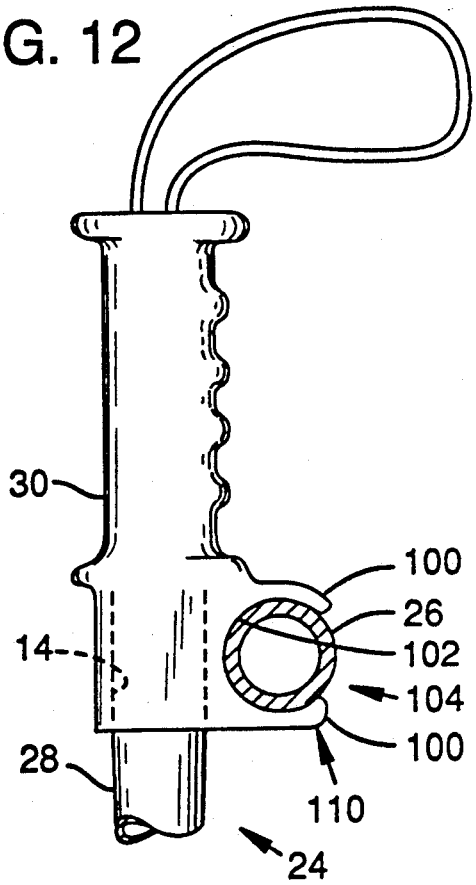

FIGS. 11 and 12 illustrate a second form of the present invention. In FIG. 11, ski pole clip 96 is formed as an integral portion of ski pole handle 30, the clip 96 and handle 30 being molded as a unitary piece. Clip 96 includes an aperture 14 for receiving shaft 28, but does not require a passage 16 as clip 96 is integrally attached to handle 30. Clip 96 includes a resilient wall formation 18 defining aperture 20 and passage 22 for attaching pole 24 to armrest 26.

The embodiment illustrated in FIG. 12 is similar to that shown in FIG. 11. The clip 110 is integrally attached to handle 30, clip 110 and handle 30 being molded in a unitary piece. In the embodiment of FIG. 12, aperture 102 is formed by a pair of semi-cylindric walls 100. The outer ends of semi-cylindric walls 100 are spaced apart, thereby forming a passageway 104 which opens horizontally. The longitudinal axis through aperture 102 is perpendicular to the longitudinal axis of ski pole 24. The pole 24 is attached to armrest 26 by pushing clip 110 over armrest 26 until the armrest 26 is grasped between the resilient walls 100 as shown in FIG. 6.

Figure 13:
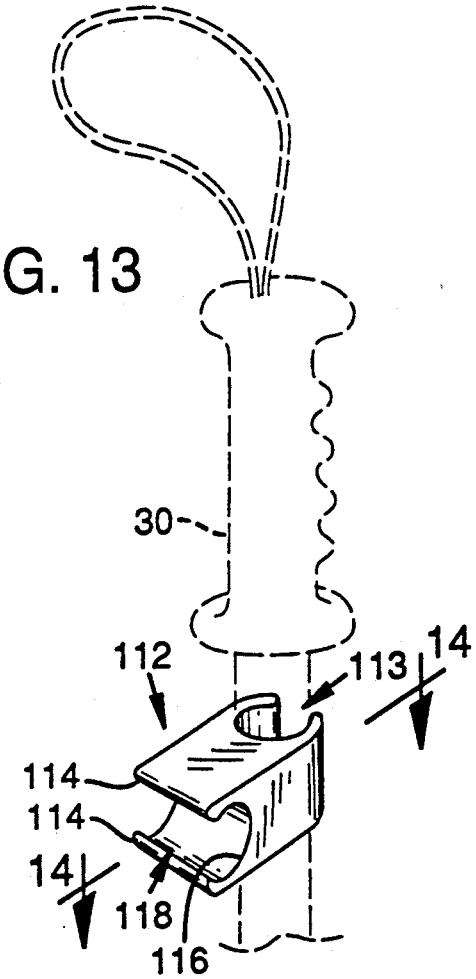
FIG. 13 is perspective view of an alternative embodiment of the present invention.

FIG. 13 illustrates another embodiment of the present invention wherein clip 112 includes an aperture 116 for attaching to armrest 26. Aperture 116 is formed by a pair of semi-cylindric walls 114 which have a passageway 118 which opens horizontally. The clip 112 is attached to the armrest 26 by moving clip 112 laterally with respect to the armrest 26 as shown by arrow 113 in FIG. 13.

Figure 14:
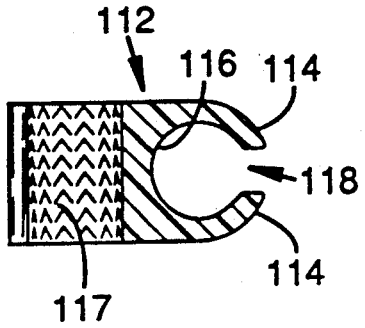
FIG. 14 is a cross section taken along line 14—14 of FIG. 13.

FIG. 14 is a cross-sectional view of the embodiment shown in FIG. 13, taken along the line 14—14. FIG. 14 shows above-described score marks 117 although such marks are optional.

A polycarbonate material found to have suitable resiliency for providing sufficient gripping force in the clip is commercially available under the trade name LEXAN 141, a general purpose grade resin commonly used for injection molding.

As shown herein, cylindric apertures 14 and 20 of clip 10 are orthogonal relative to one another such that clip 10 may attach to a horizontal portion of a ski lift and orient the ski pole vertically. Cylindric apertures 14 and 20 could be parallel relative to one another such that clip 10 could attach to a vertical portion of a ski lift and maintain the ski pole vertically.

While preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A ski pole handle and clip combination for attachment to a ski pole shaft and for attaching the ski pole shaft to a ski lift, the ski lift including a ski pole mounting structure having a substantially horizontally extending bar with a substantially circular cross-section, the ski pole handle and clip combination comprising:

a handle portion and a clip portion integrally molded as a unitary piece having a longitudinal axis substantially coincident with a longitudinal axis of the shaft when mounted thereon, the clip portion being longitudinally spaced from the handle portion, an aperture extending through said clip portion and said handle portion for receiving the upper end portion of the ski pole shaft, said clip portion including a passageway, said passageway being formed between a pair of opposed substantially semi-cylindric resilient wall formations extending outwardly from the outer wall of said clip portion, said semi-cylindric wall formations having outer ends which are spaced apart to define an opening for receiving said mounting structure bar therethrough and said passageway being sized for engaging said bar in a gripping manner maintaining said shaft in a substantially vertical orientation when attached to the ski lift.

2. The combination according to claim 1 wherein said clip portion is located at a lower end of said handle portion.

3. The combination according to claim 1 wherein said clip passageway extends transversely to the longitudinal axis of said ski pole shaft.

4. A ski pole handle and clip combination for attachment to a ski pole shaft and for attaching the ski pole shaft to a ski lift, the ski lift including a ski pole mounting structure having a substantially horizontally extending bar with a substantially circular cross-section, the ski pole handle and clip combination comprising:

a handle portion and a clip portion integrally molded as a unitary piece having a longitudinal axis substantially coincident with a longitudinal axis of the shaft when mounted thereon, the clip portion being longitudinally spaced from the handle portion, an aperture extending through said clip portion and said handle portion for receiving the upper end portion of the ski pole shaft, said clip portion including a passageway, said passageway being formed between an inwardly curved recess along an outer wall of said clip portion and a substantially semi-cylindric resilient wall formation extending outwardly and downwardly from said clip portion, said passageway having a downwardly facing opening for receiving said mounting structure bar therethrough and being sized for engaging said bar in a gripping manner maintaining said shaft in a substantially vertical orientation when attached to the ski lift.

5. The combination according to claim 4 wherein the clip portion is located at a lower end of said handle portion.

6. The combination according to claim 4 wherein said clip passageway extends transversely to the longitudinal axis of said ski pole.

* * * * *